US010113760B2

(12) United States Patent
Rotter

(10) Patent No.: US 10,113,760 B2
(45) Date of Patent: Oct. 30, 2018

(54) VENTILATION SYSTEM FOR CONTOURED ROOFS

(71) Applicant: Martin J. Rotter, Glenside, PA (US)

(72) Inventor: Martin J. Rotter, Glenside, PA (US)

( * ) Notice: Subject to any disclaimer, the term of this patent is extended or adjusted under 35 U.S.C. 154(b) by 21 days.

(21) Appl. No.: 15/484,619

(22) Filed: Apr. 11, 2017

(65) Prior Publication Data

US 2017/0276388 A1 Sep. 28, 2017

Related U.S. Application Data

(60) Provisional application No. 62/294,388, filed on Feb. 12, 2016.

(51) Int. Cl.
*F24F 7/02* (2006.01)
*E04D 13/17* (2006.01)

(52) U.S. Cl.
CPC ..... *F24F 7/02* (2013.01); *E04D 13/174* (2013.01)

(58) Field of Classification Search
CPC ..... F24F 7/02
USPC ..... 454/365
See application file for complete search history.

(56) References Cited

U.S. PATENT DOCUMENTS 5,167,579 A 12/1992 Rotter
5,561,953 A 10/1996 Rotter
5,603,657 A * 2/1997 Sells ..... E04D 13/174 454/359
5,704,834 A * 1/1998 Sells ..... E04D 13/174 454/365
5,738,581 A * 4/1998 Rickert ..... E04D 13/176 454/365
6,077,159 A * 6/2000 Clayton ..... E04D 13/174 454/250
6,079,166 A * 6/2000 Mason ..... E04D 13/174 454/365
6,212,833 B1 * 4/2001 Henderson ..... E04D 13/172 454/365
6,213,868 B1 * 4/2001 Sells ..... E04D 13/174 454/359
6,283,852 B1 * 9/2001 Igo ..... E04D 13/174 454/365
6,286,273 B1 * 9/2001 Villela ..... E04D 13/174 454/365
6,450,882 B1 * 9/2002 Morris ..... E04D 13/176 454/365

(Continued)

*Primary Examiner* — Steven B McAllister
*Assistant Examiner* — Samantha Probst
(74) *Attorney, Agent, or Firm* — Volpe and Koenig, P.C.

(57) ABSTRACT

A contoured roof ventilation system includes a support structure, with a vent opening through the support structure located along a ridge of the roof. A contoured roofing material is located on the support structure and defines a plurality of crests and valleys. First and second vent strips are located on opposite sides of the vent opening along the ridge, and have a first surface complementary to the crests and valleys of the contoured roofing material in an installed position, and a plurality of longitudinally extending slots that extend parallel to the ridge to define at least three spaced apart vent material ribbons, and a second surface. At least one water barrier is positioned above the second surfaces of the first and second vent strips and extends toward the ridge. Cap pieces having a lower surface that contacts the second surfaces of the first and second strips or the water barrier are located on the first and second strips.

9 Claims, 2 Drawing Sheets

(56) References Cited

U.S. PATENT DOCUMENTS

| | | | | |
|---|---|---|---|---|
| 6,554,700 | B2 * | 4/2003 | Dixon | E04D 13/174 454/365 |
| 6,773,342 | B2 | 8/2004 | Rotter | |
| 6,902,476 | B2 | 6/2005 | Rotter | |
| 7,644,545 | B2 * | 1/2010 | Mankell | E04D 13/1625 454/260 |
| 8,083,576 | B2 | 12/2011 | Rotter | |
| 2001/0052207 | A1 * | 12/2001 | Davis | E04D 13/174 52/199 |
| 2004/0067732 | A1 * | 4/2004 | Rotter | E04D 13/174 454/365 |
| 2006/0116069 | A1 * | 6/2006 | Urbanski | E04D 13/174 454/365 |
| 2007/0000192 | A1 * | 1/2007 | Mantyla | E04D 13/174 52/199 |
| 2007/0117505 | A1 * | 5/2007 | Wey | E04D 13/176 454/366 |
| 2007/0149110 | A1 * | 6/2007 | Reeves | E04D 13/174 454/365 |
| 2008/0220714 | A1 * | 9/2008 | Caruso | E04D 13/152 454/365 |
| 2008/0318516 | A1 * | 12/2008 | Rotter | E04D 13/174 454/365 |
| 2009/0253368 | A1 * | 10/2009 | Rotter | E04D 1/36 454/365 |
| 2010/0144266 | A1 * | 6/2010 | Lowe | E04D 13/176 454/365 |
| 2012/0045983 | A1 * | 2/2012 | Eskola, III | F24F 7/025 454/341 |
| 2014/0179220 | A1 * | 6/2014 | Railkar | E04D 3/30 454/365 |
| 2016/0108622 | A1 * | 4/2016 | Harris | E04D 13/174 454/365 |

* cited by examiner

VENTILATION SYSTEM FOR CONTOURED ROOFS

INCORPORATION BY REFERENCE

The following documents are incorporated herein by reference as if fully set forth: U.S. Provisional Application No. 62/294,388, filed Feb. 12, 2016.

BACKGROUND

This invention is related to the general field of attic and roof ventilation systems. It is particularly related to a roof ridge ventilating system for contoured roofs, such as tile or profiled metal roofs, or architectural-type shingle roofs having relatively large steps in the valleys formed between shingle tabs.

Ventilating attics under gable roofs using a vent along the roof ridge is known. Such vents are generally created by an open slot running along one or both sides of the roof ridge, essentially the length of the roof, which causes ventilation out of the attic by convection airflow and by suction from wind blowing across the roof.

Differences between the various types of ridge vents are often found in the capping structures used over the vent slot to exclude water and pests. A description of representative types of ridge vents and capping structures, and attributes or problems associated with various types, is found in a prior patent of this inventor, U.S. Pat. No. 5,167,579. That patent discloses, as a solution to many of the problems associated with prior ridge vents, an improved roof ridge venting system using a unitary mat constructed of randomly-aligned synthetic fibers which are joined by phenolic or latex binding agents and heat cured to provide an air-permeable mat with a varying mesh. Cap shingles are supported by the mat and are nailed directly to the roof through the mat. In contrast to other vent materials, the unique features of the mat disclosed in this prior patent result in many desirable physical properties such as high tensile strength, high resiliency, the ability to be transported in rolls and cut to length, ease of joining strips, durability in local ambient conditions, and the ability to act as a water and an insect barrier. Moreover, it provides the aforementioned desirable features in a thin sheet to permit the vent structure to maintain a low profile along the roof ridge.

Although the vent disclosed in the inventor's prior patent has desirable applications in many generally flat roof types, it cannot be used in conjunction with contoured roofs or with heavy roofing tiles. For contoured metal roofs, the inventor previously developed a venting system as described in U.S. Pat. No. 5,561,953. For heavy roofing tiles, which refers to roof tiles made from materials which include, but are not limited to, slate, terra cotta, concrete, and clay, the inventor has a number of prior patents, including U.S. Pat. No. 8,083,576; U.S. Pat. No. 6,902,476; and U.S. Pat. No. 6,773,342 that disclose various venting arrangements. These vent structures useable with such heavy roofing tiles generally included structure to support the capping elements, which are frequently heavy ridge cap tiles of same or similar shape and construction as the roof tiles. In these patents, a non-woven strip of air permeable material is contoured to the shape of the metal, heavy roofing tile roof profile, or other profiled roofing materials. It is also known to provide other contoured, air permeable material, which can be made, for example, from open-cell foam. However, in each of these cases, the roofing materials sometimes include a variation in contour, and the contoured, air permeable vent strip does not sufficiently conform to the profile of the roof to prevent wind driven rain from passing around the vent strip.

SUMMARY

A novel contoured roof ventilation system is provided which is designed for use with contoured roofs, such as profiled metal or plastic, architectural shingles, or heavy ridge tiles.

In one aspect, the contoured roof ventilation system includes a support structure, with a vent opening through the support structure located along a ridge of the roof. A contoured roofing material is located on the support structure and defines a plurality of crests and valleys. A first vent strip located on a first side of the vent opening along the ridge, and has a first surface complementary to the crests and valleys of the contoured roofing material in an installed position, and a plurality of longitudinally extending slots that extend parallel to the ridge to define at least three spaced apart first vent material ribbons, and a second surface. A second vent strip located generally parallel to the first vent strip on an opposite side of the roof ridge and having a first surface complementary to the crests and valleys of the contoured roofing material in an installed position, and a plurality of longitudinally extending slots that extend parallel to the ridge to define at least three spaced apart second vent material ribbons, and a second surface. At least one water barrier is positioned above the second surfaces of the first and second vent strips and extends toward the ridge. Cap pieces having a lower surface that contacts the second surfaces of the first and second strips or the water barrier are located on the first and second strips.

Other aspects of the invention are described below and in the claims

BRIEF DESCRIPTION OF THE DRAWINGS

The present invention will be explained in more detail in connection with the drawings in which presently preferred embodiments are shown.

In the drawings.

DETAILED DESCRIPTION OF THE PREFERRED EMBODIMENTS

Figure 1:
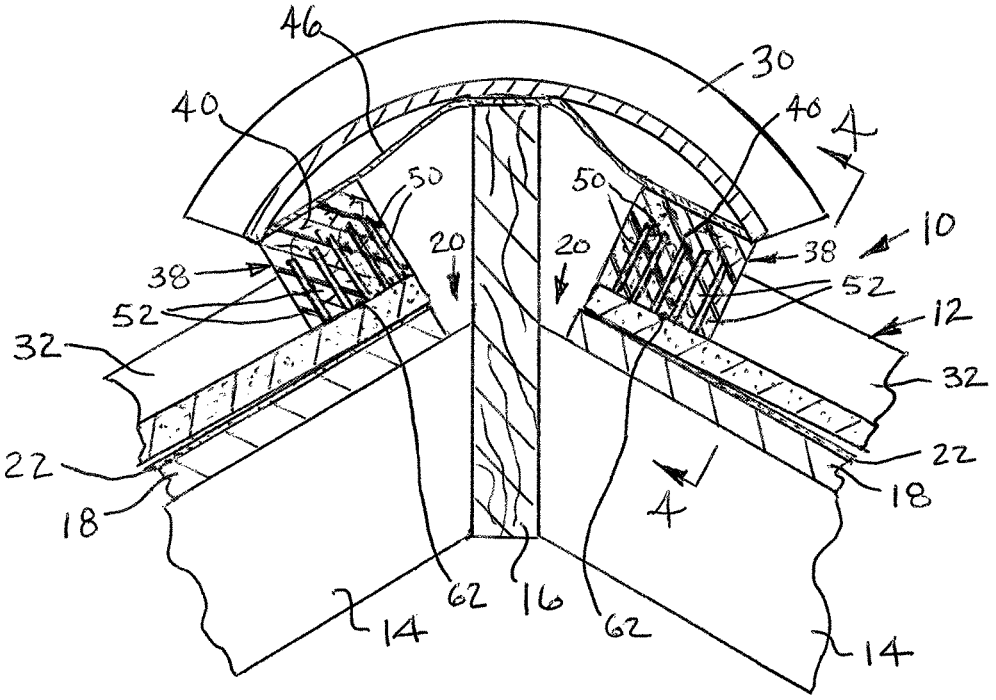
FIG. 1 is a cross-sectional view through a roof ridge showing the contoured roof ventilation system according to a preferred embodiment.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted.

The preferred embodiments of the present invention will be described with reference to the drawing figures where like numerals represent like elements throughout.

Referring now to FIGS. 1-4, a contoured roof ventilation system 10 is shown. The contoured roof 12 includes a roof structure formed from roof rafters 14 that are connected to a ridge pole or beam 16. Sheathing 18 may be applied over the rafters 14, as shown, and a gap or slot 20 is left on each side of the ridge pole 16 for the ridge vent. Alternatively, purlins or other support structures can be utilized. The ridge pole 16 may extend above the sheathing 18, or can be built up to a desired height, so that the cap pieces 30 for the contoured roof 12 can be affixed to it, depending on the type of roofing material being installed. Roofing felt or another water barrier 22 is preferably applied over the sheathing 18. The contoured roofing material 32, which can be contoured roofing panels, tiles, architectural shingles, or other contoured material, are then placed in position on the roof until the final, uppermost edge of the contoured roofing material 32 ends at a point below the slots 20.

Figure 2:
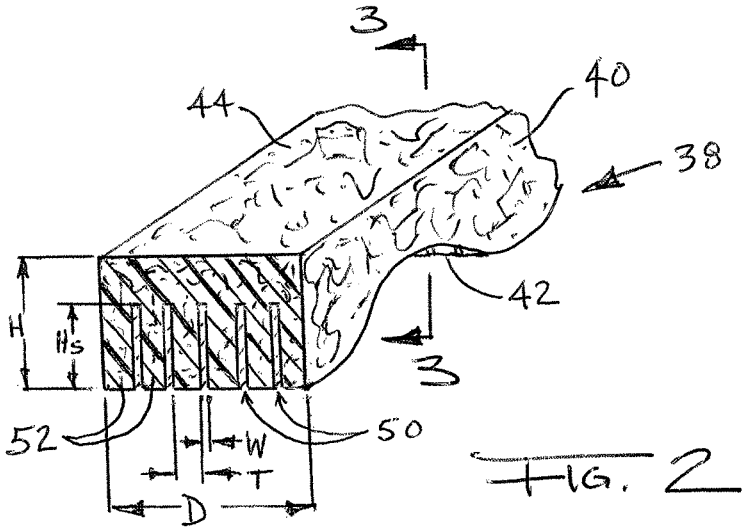
FIG. 2 is a perspective view of the vent strip used in the contoured roof ventilation system shown in FIG. 1.

As shown in FIGS. 1 and 2, the ventilation system 10 is comprised of first and second vent strips 38 formed from a contoured vent material 40. The vent material 40 is preferably a non-woven synthetic material that has a high net open free area to allow for air passage therethrough, while acting as a filter to prevent ingress by bugs or debris. The material also prevents moisture permeation, such as wind driven rain, under conditions required by building code, while still allowing air flow for attic ventilation. A preferred material is disclosed in the inventors prior U.S. Pat. No. 5,167,579. However, other suitable mesh materials, whether woven or non-woven may be utilized, such as UV stable open cell foam. The vent material 40 has a first surface 42, shown in FIG. 2, which is contoured with a complementary profile to the contoured roofing material 32, at least in the installed position. A plurality of longitudinally extending slots 50 that extend parallel to the ridge, as defined for example by the ridge pole 16, are formed in the vent material 40 and extend in from the first surface 42 to define at least three spaced apart vent material ribbons 52. The slots 50 can be cut into the vent material 40. The vent material 40 also has a second surface 44, generally opposite to the first surface 42, that is generally flat.

Figure 3:
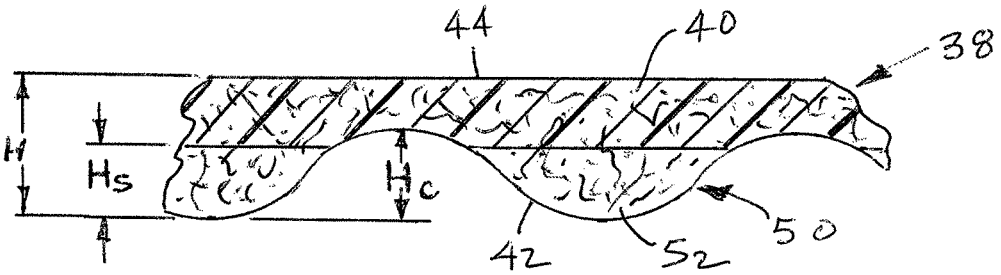
FIG. 3 is a view taken along line 3-3 in FIG. 2.

The vent material 40 preferably has a height H that is greater than a depth $H_C$ of the valleys in the contoured roofing material 32, as shown in FIG. 3, so that it can be contoured and remain in one piece.

The slots 50 preferably have a width W of 1/16 to 1/4 inch. Further, the slots 50 preferably have a height $H_S$ that extend up to 80% or less of a height H of the vent strips 38 such that the portion without the slots 50 holds the vent material ribbons 52 in place with the slots therebetween. The vent material ribbons 52 preferably have a thickness T of at least 1/8 inch. The slots 50 may extend to a point below a maximum height $H_C$ of the contour on the first surface 42 of the vent strips 38, as shown in FIG. 3. The slots 50 preferably provide sufficient gaps in the vent strip 38 in an upslope direction of the roof to prevent wicking of moisture or wind driven rain through the depth D of the vent strip 38. Further, the width W of the slots 50, the height $H_S$, and the thickness T of the vent material ribbons 52 is selected such that the vent material 40 can elastically deflect or deform in an installed state as shown in FIG. 1 in order to provide for a better fit to a roof contour. The contour can be formed into the vent strips 38 upon installation, or the contour can also be pre-formed or cut into the vent material 40 along with the slots 50. This arrangement with the slots 50 can allows contoured roof material profiles that are similar to use the same vent strips 38. It is noted that FIG. 3 shows $H_S<H_C$. However, this is not required, and it is also possible that $H_S \geq H_C$.

Additionally, for contoured roofing material 32 with small contours, such as architectural shingles, the first surface 42 of the vent strip 40 may be flat (although interrupted by the slots 50) in an uninstalled state, and the first surface 42 is deformed to be complementary to the crests and valleys of the contoured roofing material 32 in an installed position by pressure exerted by the cap pieces 30 being installed and pressing the vent material 40 into the desired contour. This is facilitated by the arrangement of the slots 50 and vent material ribbons 52.

The material 40 may be formed as a single piece, or may be made of a plurality of pieces of material that are connected together, such as by adhesives, sewing, heat staking, heat or friction welding or fusion, or any other suitable means. The layers may be made of the same or different materials, with at least one layer of material being air permeable. The vent material 40 is preferably adhered to the contoured roof material 32 by an adhesive 62 applied to at least one of the vent material 40 and the contoured roof material 32.

An upper water barrier 46 is affixed to the second surface 44 of the vent material 40. The upper water barrier 46 is wide enough so that it will extend over the ridge pole 16 in the installed position, and at least partially overlaps the second surface 44 of the second strip 38 of the vent material 40 on an opposite side of the ridge. The upper water barrier 46 is preferably made of a closed cell foam material or a polyvinyl chloride or other polymeric sheet material, but may be made from any suitable water resistant material that can be adhered to or affixed to the vent material 40, such as by an adhesive, heat staking, sewing, solvent or heat welding, or by any other suitable means. Alternatively, each of the vent strips 40 can have a water barrier 46 that extends over the ridge pole 46, and an adhesive material may be applied to one or both sides of the free ends of the upper water barriers 46, so that upon installation, the upper water barriers 46 from the vent strips 38 overlap and can be adhered to one another. However, this is not required.

Referring again to FIG. 1, for installation, the vent strips 38 are located on the contoured roof material 32 at each side of the roof ridge. The first surface 42 of each strip 38 is located on the complementary projections and recesses of the roof material 32, with the upper water barrier 46 overlapping the ridge pole 16 and the upper surfaces 44 of both vent strips 38. The adhesive 62 attaches the vent strips 38 to the contoured roof material 32. The adhesive 62 may include a fluid or semi-solid substance applied to at least one of the vent strips 38 and the contoured roof material 32 during the installation process. Alternatively, the adhesive 62 may include adhesive strips, of the type known in the art, supplied pre-attached along the first surface 42 of each vent strip 38. These adhesive strips preferably include a release strip which, when removed, reveals an adhesive such as acrylic or silicone.

Since the two vent strips 38 are not required to be connected together, no specific alignment of the contoured roof material 32 on either side of the ridge is required. Additionally, the spacing of the vent strips 38 from the ridge pole 16 can be adjusted to any width of cap pieces 30 since the upper water barrier 46 can be adjustable based on its configuration. If an adhesive is provided on one or both free ends of the upper water barriers 46 of the vent strips 38, upper water barriers 46 that extend from each vent strip 38 are adhered together. The cap pieces 30 are then installed and preferably connected to the ridge pole 16 with fasteners (not shown).

Figure 4:
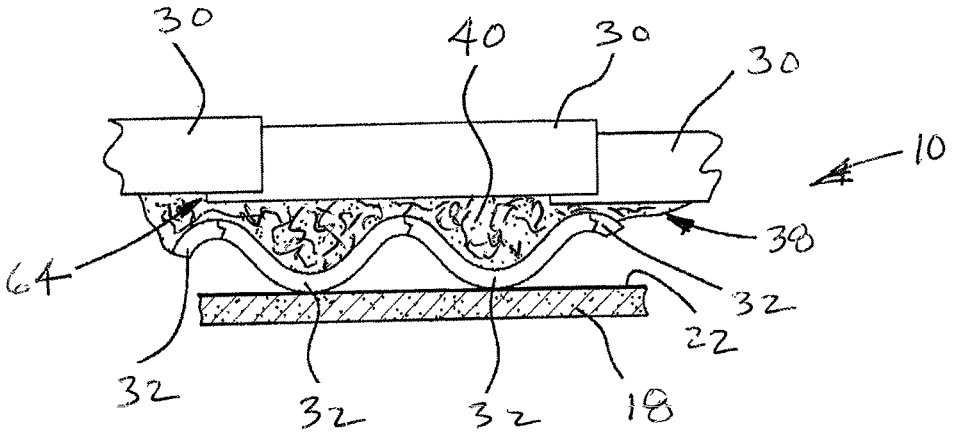
FIG. 4 is a view taken along line 4-4 in FIG. 1.

As shown in FIG. 1, the vent material 40 is partially compressed by the cap pieces 30 so that any gaps 64, shown in FIG. 4, are filled. Additionally, in a preferred embodiment where the vent material is at least partially formed of a non-woven synthetic fiber matting as described, for example in U.S. Pat. No. 5,167,579, the vent material 40 is preferably heated so that it "lofts" or expands and is then calendered down to a specific thickness prior to any profiles being cut to match the roof contours. Since the material 40 is calendered, it can also expand somewhat due to sun generated heat on the roof after installation in order to further fill the gaps to prevent the ingress of insects or debris.

While the preferred embodiments of the invention have been described in detail, the invention is not limited to these specific embodiments described above which should be considered as merely exemplary. Further modifications and extensions of the present invention may be developed and all such modifications are deemed to be within the scope of the present invention as defined by the appended claims.

What is claimed is:

1. A contoured roof ventilation system, comprising:

a support structure;

a vent opening through the support structure located along a ridge of the roof;

a contoured roofing material located on the support structure defining a plurality of crests and valleys;

a first vent strip made of a vent material located on a first side of the vent opening along the ridge, and having a first surface complementary to the crests and valleys of the contoured roofing material in an installed position, and a plurality of longitudinally extending slots that extend parallel to the ridge to define at least three spaced apart first vent material ribbons of the vent material, and a second surface;

a second vent strip made of the vent material located generally parallel to the first vent strip on an opposite side of the roof ridge and having a first surface complementary to the crests and valleys of the contoured roofing material in an installed position, and a plurality of longitudinally extending slots that extend parallel to the ridge to define at least three spaced apart second vent material ribbons of the vent material, and a second surface;

at least one water barrier positioned above the second surfaces of the first and second vent strips and extending toward the ridge; and cap pieces having a lower surface that contacts the second surfaces of the first and second strips or the water barrier located on the first and second strips.

2. The system of claim 1, wherein the first and second vent strips are comprised of a porous material.

3. The system of claim 2, wherein the porous material is a synthetic fiber mesh.

4. The system of claim 1, wherein the first and second vent strips include contouring on the respective first surfaces for mating with complementing contouring of the crests and valleys of the contoured roofing material.

5. The system of claim 1, wherein the first and second vent strips include adhesive applied thereon for securing the first and second vent strips to the contoured roofing material.

6. The system of claim 1, wherein the slots have a width of 1/16 to 1/4 inch.

7. The system of claim 1, wherein the slots extend up to 80% or less of a height of the vent strips.

8. The system of claim 1, wherein the vent material ribbons have a thickness of at least 1/8 inch.

9. The system of claim 1, wherein the slots extend to a point below a maximum height of a contour on the respective first surfaces of the first and second vent strips for mating with complementing contouring of the crests and valleys of the contoured roofing material.

* * * * *